US008475709B2

(12) United States Patent
Bergmark et al.

(10) Patent No.: US 8,475,709 B2
(45) Date of Patent: Jul. 2, 2013

(54) POWDER METAL POLYMER COMPOSITES

(75) Inventors: Pontus Bergmark, Billdal (SE); Björn Skärman, Höganäs (SE)

(73) Assignee: Hoganas AB (Publ), Hoganas (SE)

( * ) Notice: Subject to any disclaimer, the term of this patent is extended or adjusted under 35 U.S.C. 154(b) by 637 days.

(21) Appl. No.: 12/529,046

(22) PCT Filed: Mar. 7, 2008

(86) PCT No.: PCT/SE2008/050261

§ 371 (c)(1),
(2), (4) Date: Sep. 29, 2009

(87) PCT Pub. No.: WO2008/115130

PCT Pub. Date: Sep. 25, 2008

(65) Prior Publication Data

US 2010/0015432 A1 Jan. 21, 2010

Related U.S. Application Data

(60) Provisional application No. 60/907,115, filed on Mar. 21, 2007.

(30) Foreign Application Priority Data

Mar. 21, 2007 (DK) ..... 2007 00435

(51) Int. Cl.
*B22F 7/00* (2006.01)
*C22C 47/00* (2006.01)
*C22C 33/02* (2006.01)

(52) U.S. Cl.
USPC ..... 419/11; 419/36; 419/38; 75/246

(58) Field of Classification Search
USPC ..... 75/228–250, 255, 252, 253, 254, 75/950; 148/100–105, 108, 110–113, 120–122, 148/513, 300–319; 428/545–687, 320.2, 428/321.1, 321.3, 321.5, 322.2, 322.7, 323–339, 428/411.1, 457–472, 688, 539.5, 304.4, 307.3, 428/307.7
See application file for complete search history.

(56) References Cited

U.S. PATENT DOCUMENTS

| | | | | |
|---|---|---|---|---|
| 4,184,972 | A | 1/1980 | Pevzner et al. | |
| 5,993,729 | A | 11/1999 | Lefebvre et al. | |
| 6,102,980 | A | 8/2000 | Endo et al. | |
| 6,331,270 | B1 | 12/2001 | Lefebvre et al. | |
| 6,485,579 | B1 | 11/2002 | Nillius et al. | |
| 6,548,012 | B2 * | 4/2003 | Lefebvre et al. | 419/27 |
| 2003/0144155 | A1 | 7/2003 | Tenne et al. | |
| 2003/0217828 | A1 | 11/2003 | Opoku-Adusei et al. | |
| 2006/0062985 | A1 * | 3/2006 | Karandikar | 428/292.1 |
| 2006/0166003 | A1 * | 7/2006 | Khabashesku et al. | 428/413 |
| 2007/0003749 | A1 * | 1/2007 | Asgari | 428/304.4 |

FOREIGN PATENT DOCUMENTS

| | | | |
|---|---|---|---|
| DE | 197 09 651 | | 10/1997 |
| EP | 0 369 928 | | 5/1990 |
| EP | 0 790 223 | | 8/1997 |
| EP | 1 763 040 | | 3/2007 |
| JP | 2000-277315 | A | 10/2000 |
| JP | 2004-178643 | | 6/2004 |
| JP | 2006-005093 | A | 1/2006 |
| WO | WO 2005/064621 | A1 | 7/2005 |
| WO | WO 2006/080936 | | 8/2006 |
| WO | WO 2006/135324 | A1 | 12/2006 |

OTHER PUBLICATIONS

International Search Report of Application No. PCT/SE2008/050261 dated Jul. 8, 2008.
Written Opinion of the International Searching Authority of Application No. PCT/SE2008/050261 dated Jul. 8, 2008.
Supplementary European Search Report dated Dec. 27, 2010, issued in the corresponding European Application No. 08724208.7-1215.

* cited by examiner

*Primary Examiner* — Scott Kastler
*Assistant Examiner* — Vanessa Luk
(74) *Attorney, Agent, or Firm* — Buchanan Ingersoll & Rooney

(57) ABSTRACT

A method for producing a composite part is provided. The method comprises compacting a powder composition comprising a lubricant into a compacted body; heating the compacted body to a temperature above the vaporization temperature of the lubricant such that the lubricant is substantially removed from the compacted body; subjecting the obtained heat treated compacted body to a liquid polymer composite comprising nanometer-sized and/or micrometer-sized reinforcement structures; and solidifying the heat treated compacted body comprising liquid polymer composite by drying and/or by at least one curing treatment.

17 Claims, No Drawings

POWDER METAL POLYMER COMPOSITES

FIELD OF THE INVENTION

The present invention relates to a new method of producing a composite part. The method comprises the step of compaction of a powder composition into a compacted body, followed by a heat treatment step whereby an open pore system is created and followed by an infiltration step. The invention further relates to a composite part.

BACKGROUND

Soft magnetic materials can be used for applications such as core materials in inductors, stators, and rotors for electrical machines, actuators, sensors, and transformer cores. Traditionally, soft magnetic cores, such as rotors and stators in electric machines, are made of stacked steel-sheet laminates. However, in the last few years there has been a keen interest in so called Soft Magnetic Composite (SMC) materials. The SMC materials are based on soft magnetic particles, usually iron based, with an electrically insulating coating on each particle. By compacting the insulated particles, optionally together with lubricants and/or binders, using the traditionally powder metallurgy process, the SMC parts are obtained. By using the powder metallurgical technique it is possible to produce materials having a higher degree of freedom in the design of the SMC part compared to using steel-sheet laminates, as the SMC material can carry a three dimensional magnetic flux and as three dimensional shapes can be obtained with the compaction process.

As a consequence of the increased interest in the SMC materials, improvements of the soft magnetic characteristics of the SMC materials is the subject of intense studies in order to expand the utilisation of these materials.

In order to achieve such improvement, new powders and processes are continuously being developed.

Two key characteristics of an iron core component are its magnetic permeability and core loss characteristics. The magnetic permeability of a material is an indication of its ability to become magnetised or its ability to carry a magnetic flux. Permeability is defined as the ratio of the induced magnetic flux to the magnetising force or field intensity. When a magnetic material is exposed to an alternating field, such as for example an alternating electric field, energy losses occur due to both hysteresis losses and eddy current losses. The hysteresis loss is brought about by the necessary expenditure of energy to overcome retained magnetic forces within the iron core component and is proportional to the frequency of e.g. the alternating electrical field. The eddy current loss is brought about by the production of electric currents in the iron core component due to the changing flux caused by alternating current (AC) conditions and is proportional to the square of the frequency of the alternating electrical field. A high electrical resistivity is then desirable in order to minimise the eddy currents and is of special importance at higher frequencies, such as for example above about 60 Hz. In order to decrease the hysteresis losses and to increase the magnetic permeablity of a core component it is generally desired to heat-treat a compacted part whereby the induced stresses from the compaction are reduced. Furthermore, in order to reach desired magnetic properties, such as high magnetic permeability, high induction and low core losses, high density of the compacted part is often needed. High density is here defined as a density above 7.0, preferably above 7.3 most preferably about 7.5 g/cm3 for an iron-based compacted part.

In addition to the soft magnetic properties, sufficient mechanical properties are essential. High mechanical strength is often a prerequisite to avoid introducing cracks, laminating, and break-outs and to achieve good magnetic properties of compacts which after compaction and heat treatment have been subjected to machining operations. Also, lubricating properties of an impregnated polymer network can increase the lifetime of cutting tools considerably.

In order to be able to expand the utilisation of SMC components, high strength at elevated temperature is an important property such as for example for components used in applications such as motor cores, ignition coils, and injection valves in automobiles.

By admixing a binder to the SMC powder before compaction, improved mechanical strength of the compacted and heat treated component can be obtained. In the patent literature several kinds of organic resins, such as thermoplastics and thermoset resins, inorganic binders such as silicates or silicon resins, are reported. The heat treatment of organic resin bonded components is restricted to comparatively low temperatures, below about 250° C., as the organic material destroys at temperature above about 250° C. The mechanical strength of heat treated organic bonded components at ambient conditions is good, but deteriorates above 100° C. Inorganic resins can be subjected to higher temperatures without effecting the mechanical properties, however, the use of inorganic binders are often associated with poor powder properties, poor compressibility, poor machinability and often needed in high amounts that precludes higher density levels.

U.S. Pat. No. 6,485,579 describes a method of increasing the mechanical strength of SMC component by heat treating the component in the presence of water vapour. Higher values for the mechanical strength are reported compared to components heat treated in air, however, increased core losses are obtained. A similar method is described in WO2006/135324 where high mechanical strength in combination with improved magnetic permeability are obtained provided metal free lubricants are used. The lubricants are evaporated in a non-reducing atmosphere before subjecting the component to water vapour. However, the oxidation of the iron particles, when the component is subjected to steam treatment, will also increase the coercive forces and thus core losses.

Impregnation, infiltration, and sealing of die casts or powder metal (P/M)-components, e.g. by an organic network, are known methods in order to prevent surface corrosion or seal surface porosity. Highly dependent on density and processing conditions of P/M parts, the degree of penetration of the organic network will vary. Low density levels (<89% of the theoretical density) and mild sintering conditions or heat treatments provide for easy penetration and full impregnation. For high performance materials having high density and low porosity the prerequisites to reach full impregnation are limited.

Impregnation of SMC components to improve the machinability for producing prototype components, or to improve the corrosion resistance, is shown for example in patent application JP 2004 178 643 where the impregnation liquid constitutes of oils in general. Besides the marginally improved machinability of this method it results in greasy and slippery surfaces, worse to handle. Oil does not greatly improve cutting tool life because it never becomes solid. In the same way, uncured or soft sealants offer little value to machining. A reliable cure mechanism for the polymer together with high mechanical strength of the composite part is the best assurance of consistent machining performance.

U.S. Pat. Nos. 6,331,270 and 6,548,012 both describe processes for manufacturing AC soft magnetic components from non-coated ferromagnetic powders by compaction of the powders together with a suitable lubricant followed by heat treatment. It is also stated that for applications requiring higher mechanical strength, the components may be impregnated, for example with epoxy resin. As non-coated powders are used, these methods are less suitable due to high eddy current losses obtained if the components are used for applications subjected to higher frequencies, above about 60 Hz. U.S. Pat. No. 5,993,729 deals mainly with uncoated iron-based powder and infiltration of low density compacts produced with the aid of die wall lubrication. The patent also mentions powders, wherein the particles are individually coated with a non-binding electro-insulating layer, comprising of oxides applied either by sol-gel process or by phosphatation. The compacted soft magnetic elements according to U.S. Pat. No. 5,993,729, are restricted to applications working at low frequencies, below about 60 Hz, due to poor electrical resistivity. In addition, the oxidative heat treatment of powder or compacts before the impregnation process will restrict or fully prevent pore penetration of the impregnating liquid, especially for compacts of high density, above about 7.0 g/cm$^3$, and especially above about 7.3 g/cm$^3$.

OBJECT OF THE INVENTION

An object of the present invention is to provide a method for increasing the mechanical strength of heat treated (SMC) components, especially components having a density above about 89% of the theoretical density, (for components produced from iron-based powders above about 7.0 g/cm3.) and having lower coersivity compared to SMC compacts where higher mechanical strength has been achieved by conventional heat treatment in an oxidizing atmosphere.

A further object of the invention is to provide a method for manufacturing impregnated components having both high density and high mechanical strength at elevated temperatures, for example above about 150° C.

SUMMARY OF THE INVENTION

The above mentioned objects of the invention are obtained by a method for producing composite parts, the method comprising the steps of compacting a powder composition comprising a lubricant into a compacted body; heating the compacted body to a temperature above the vaporisation temperature of the lubricant such that the lubricant substantially is removed from the compacted body, subjecting the obtained heat treated compacted body to a liquid polymer composite comprising nanometer-sized and/or micrometer-sized reinforcement structures, and solidifying the heat treated compacted body comprising liquid polymer composite by drying and/or by at least one curing treatment.

By subjecting the heat treated compacted body to a liquid polymer comprising nanometer-sized and/or micrometer-sized reinforcement structures, the liquid polymer composite is enabled to impregnate and/or infiltrate the heat treated compacted body, also if the compacted body comprises small cavities. By subsequently solidifying the heat treated compacted body comprising the liquid polymer composite provides an interpenetrating network comprising nanometer-sized and/or micrometer-sized reinforcement structures which thereby results in a heat treated compacted body with increased mechanical strength and increased machinability compared to conventional impregnation and/or infiltration methods.

The organic interpenetrating network of the present invention, gives besides an improved mechanical strength, also enhanced machinability properties, as compared to conventional impregnation or infiltration methods. The organic polymer may be chosen to give the impregnated compact high mechanical strength at elevated temperatures, above about 100 MPa at about 150° C.

The present invention allows successful impregnation of compacts of up to 98% of theoretical density. Also, the introduction of an interpenetrating network, which may have lubricating properties, into a compacted body may considerably increase the life time of cutting tools and machinery used to process the heat treated compacted body compared to conventional impregnation and/or infiltration methods.

In an embodiment of the invention, the powder composition further comprises a soft magnetic powder, preferably iron-based soft magnetic particles, wherein the particles further comprise an electrically insulated coating.

Thus, the method may also produce soft magnetic parts/components and thereby combine the increased mechanical strength of the heat treated compacted body with improved soft magnetic properties.

Still further, the method may improve the machinability properties of an SMC component, which may preserve good magnetic properties after a machining operation.

Additionally, the method enables manufacturing of impregnated soft magnetic components having both high density and high mechanical strength. The increased density and mechanical strength may also be present at elevated temperatures, for example above about 150° C.

Additionally, the invention thus provides a method for producing a soft magnetic composite component having noise reducing or acoustic damping properties for, e.g. noise caused by dynamic forces such as magnetostriction forces.

In an embodiment of the invention, the reinforcement structures comprise carbon nanotubes preferably single-wall nanotubes.

The carbon nanotubes provide increased strength to the heat treated compacted body. The reinforcement structures may have been chemically functionalized In an embodiment of the invention, the method further comprises the step of sintering the heat treated body after the heat treatment of the compacted body.

In this way, the method according to the invention may be applied on for example sintered parts. Thus, components subjected to heating temperatures at which sintering occur may also be produced by the method. In case of sintering, the powder particles do not need to be coated.

Further embodiments of the method are described in the detailed description below together with the dependent claims and the figures.

Additionally, the invention further describes a composite part.

DETAILED DESCRIPTION OF THE INVENTION

In contrast to known impregnation or infiltration methods, the present invention enables the polymer composite liquid to fully penetrate bodies even of such high densities as 7.70 g/cm3 for compacts produced of iron based powders. An impregnated SMC compact according to the present invention can thus exhibit unexpectedly high mechanical strength in a wide interval from cryogenic to high temperatures (for example above about 150° C.), improved machining properties, and improved corrosion resistance.

A further aspect of polymer impregnated SMC compacts is an apparent damping of acoustic properties (i.e. noise reduction) at high induction and high frequency applications. The noise arising from dynamic forces as e.g. magnetostriction, or other mechanical loads, can be reduced with an impregnation, as compared to non-impregnated compacts. The noise reduction increases with the volume fraction of impregnant (i.e. lower compacted density).

The soft magnetic powders used according to the present invention may be electrically insulated iron-based powders such as pure iron powders or powders comprising an alloy of iron and other elements such as Ni, Co, Si, or Al. For example, the soft magnetic powder may consist substantially of pure iron or may at least be iron-based. For example, such a powder could be e.g. commercially available water-atomised or gas-atomised iron powders or reduced iron powders, such as sponge iron powders.

The electrically insulating layers, which may be used according to the invention, may be thin phosphorous comprising layers and/or barriers and/or coatings of the type described in the U.S. Pat. No. 6,348,265, which is hereby incorporated by reference. Other types of insulating layers may also be used and are disclosed in e.g. the U.S. Pat. Nos. 6,562,458 and 6,419,877. Powders, which have insulated particles and which may be used as starting materials according to the present invention, are e.g. Somaloy® 500 and Somaloy® 700 available from Höganäs AB, Sweden.

The type of lubricant used in the metal powder composition may be important and may, for example, be selected from organic lubricating substances that vaporize at temperatures above about 200° C. and if applicable below a decomposition temperature of the electrically insulating coating or layer The lubricant may be selected to vaporize without leaving any residues that can block pores and thereby prevent subsequent impregnation to take place. Metal soaps, for example, which are commonly used for die compaction of iron or iron-based powders, leave metal oxide residues in the component. However, in case of density less than 7.5 g/cm3, the negative influence of these residues is less pronounced, permitting the use of metal-containing lubricants at this condition.

Another example of lubricating agents are fatty alcohols, fatty acids, derivates of fatty acids, and waxes. Examples of fatty alcohols are stearyl alcohol, behenyl alcohol, and combinations thereof. Primary and secondary amides of saturated or unsaturated fatty acids may also be used e.g. stearamide, erucyl stearamide, and combinations thereof. The waxes may, for example, be chosen from polyalkylene waxes, such as ethylene bis-stearamide.

The amount of lubricant used may vary and may for example be 0.05-1.5%, alternatively 0.05-1.0%, alternatively 0.1-0.6% by weight of the composition to be compacted.

An amount of lubricant of less than 0.05% by weight of the composition may give poor lubricating performance, which may result in scratched surfaces of the ejected component, which in turn may block the surface pores and complicate the subsequent vaporization and impregnation processes. The electrical resistivity of compacted components produced from coated powders may be affected negatively, mainly due to a deteriorated insulating layer, caused by both poor internal and external lubrication.

An amount of lubricant of more than 1.5% by weight of the composition may improve the ejection properties but generally results in too low green density of the compacted component, thus, giving low magnetic induction and magnetic permeability.

The compaction may be performed at ambient or elevated temperature. The powder and/or the die may be preheated before compaction. For example, the die temperature may be adjusted to a temperature of not more than 60° C. below the melting temperature of the used lubricating substance. For example, for stearamide, the die temperature may be 40-100° C., as stearamide melts at approximately 100° C.

The compaction may be performed between 400 and 1400 MPa. Alternatively, the compaction may be performed at a pressure between 600 and 1200 MPa.

The compacted body may subsequently be subjected to heat treatment in order to remove the lubricant in a non-oxidative atmosphere at a temperature above the vaporization temperature of the lubricant. In case the powder is coated with an insulating layer—the heat treatment temperature may be below the temperature of the decomposition temperature of the inorganic electrically insulating layer.

For example, for many lubricants and insulating layers this means that the vaporisation temperature should be below 650° C., e.g below 500° C. such as between 200 and 450° C. The method according to the present invention, however, is not particularly restricted to these temperatures. The heat treatment may be conducted in an inert atmosphere, in particular a non-oxidizing atmosphere, such as for example nitrogen or argon.

If the heat treatment is conducted in an oxidative atmosphere, surface oxidation of the iron or iron-based particles may take place and may restrict or prevent an impregnant, (i.e. impregnation liquid) to flow into the porous network of the compacted body. The extent of the oxidation is dependent on the temperature and oxygen potential of the atmosphere. For example, if the temperature is less than about 400° C. in air, an adequate penetration of impregnant can take place. This may give the impregnated compact an acceptable mechanical strength, but may yield an unacceptable stress relaxation with poor magnetic properties as a consequence.

The delubricated body may subsequently be immersed into an impregnant, for example in a impregnation container. Subsequently, the pressure in the impregnation container may be reduced. After the pressure of the impregnation container has reached approximately below 0.1 mbar, the pressure is returned to atmospheric, whereby the impregnant is forced to flow into the pores of the compacted body until the pressure is equalized. Depending on the viscosity of the impregnant, density of the compact, and size of the compact, the time and pressure required to fully impregnate the compact may vary.

The impregnation may be conducted at elevated temperatures (for example up to 50° C.) in order to decrease the viscosity of the liquid and improve the penetration of the impregnant into the compacted body, as well as to reduce the time required for the process.

Further, the compact may be subjected to a reduced pressure and/or elevated temperatures before it is immersed in the impregnant. Thereby, entrapped air and/or condensed gases present inside the compacts may be removed and thus, the subsequent impregnation may proceed faster. The penetration may also proceed faster and/or more completely if the pressure is raised above ambient pressure level after the impregnation treatment in low pressure.

However, care must be taken that the stochiometry of the impregnant is not altered by losses of volatile material during the vacuum process. Thus, the impregnation time, pressure, and temperature may be decided by a person skilled in the art in view of the component density, the temperature and/or atmosphere wherein the component was heat treated, as well as desired strength, penetration depth, and the type of impregnant.

The impregnation process is initiated at the surface of the compacted body and penetrates in towards the centre of the body. In some cases a partial impregnation may be accomplished and thus according to one embodiment of the invention the impregnation process is terminated before the surfaces of all particles of the compacted body have been subjected to the impregnation liquid. In this case an impregnated crust may surround an unimpregnated core. Thus, provided the degree of penetration has given the component an acceptable level of mechanical strength and machining properties, the impregnation process may be terminated before complete penetration throughout the compacted body has taken place.

In cases where the chemical compatibility between the metal network of the compacted body and the impregnant is not favourable, the surface of the interpenetration voids of the compacted body may be treated with surface modifiers, cross-linkers, coupling and/or wettability agents, such as organic functional silanes or silazanes, titanates, aluminates, or zirconates, prior to impregnation treatment according to the invention. Other metal alkoxides as well as inorganic silanes, silazanes, siloxanes, and silicic acid esters may also be used.

In some cases where the penetration of the liquid polymer composite into the compacted body is especially difficult, the impregnation process may be improved with the help of magnetostriction forces. The parts, the compacted body and the impregnation fluid, may thereby be exposed to an external alternating magnetic field during the impregnating process.

Superfluous impregnant may be removed before the impregnated compact is cured at elevated temperature and/or anaerobic atmosphere. The superfluous impregnant may for example be removed by centrifugal force and/or pressurized air and/or by an immersion in a suitable solvent. Procedures of impregnation, such as for example the methods employed by SoundSeal AB, Sweden, and P. A. System srl, Italy, may be applied. The process of removing superfluous impregnant may, for example, be performed batchwise in vacuum chambers and/or vacuum furnaces that are commercially available.

The polymer systems for impregnation according to the present invention may, for example, be curable organic resins, thermoset resins, and/or meltable polymers that solidify below their melting temperature to a thermoplastic material.

The polymer system may be any system or combination of systems that suitably allow for integration with nanometer-sized structures by physical and/or chemical forces such as for example Van der Waals forces, hydrogen bonds, and covalent bonds.

In order to simplify handling and to use the resin in continuous operations, the polymer systems may for example be chosen from the group of resins which cure at elevated temperatures (e.g. above about 40° C.) and/or in an anaerobic environment. Examples of such polymer systems for impregnation may, for example, be epoxy or acrylic type resins showing low viscosity at room temperature and having good thermo stability.

Thermoset resins according to the present invention, may, for example, be cross-linked polymer species such as polyacrylates, cyanate esters, polyimides and epoxies. Thermoset resins exemplified by epoxies may be resins wherein cross-linking occurs between the epoxi resin species comprising epoxide groups and curing agents composing corresponding functional groups for crosslinking. The process crosslinking is termed "curing".

The polymer system can be any system or combination of systems that suitably allow for integration with nanometer-sized structures by physical and chemical forces as Van der Waals forces, hydrogen bonds, and covalent bonds.

Examples of epoxies include, but are not limited to, diglycidyl ether of bisfenol A (DGBA), bisfenol F type, tetraglycidyl methylene dianiline (TGDDM), novolac epoxy, cycloaliphatic epoxy, brominated epoxy.

Examples of corresponding curing agents comprise, but are not limited to, amines, acid anhydrides, and amides etc. The variety of curing agents may further be exemplified by amines; cycloalifatic amines such as bis-paraminocyclohexyl methane (PACM), alophatic amines such as tri-etylene-tetra-amine (TETA) and di-etylene-tri-amine (DETA), aromatic amines such as diethyl-toluene-diamine and others.

Anaerobe resins may be selected from any polymer or oligomer base that is crosslinked on removal of oxygen, exemplified by acrylics as urethane acrylate, metacrylate, methyl methacrylate, methacrylate ester, polygycole di- or monoacrylate, allyl methacrylate, tetrahydro furfuryl methacrylate and more complex molecules as hydroxiethyl-methacrylate-N—N-dimethyl-p-touidin-N-oxide and combinations hereof.

Thermoplastics according to the invention may be meltable materials that also may be heated for impregnation. Examples of materials for impregnation comprise a range from low temperature polymers such as polyethylene (PE), polypropylene (PP), ethylenevinyleacetate to high temperature materials such as polyeterimide (PEI), polyimide (PI), fluorethylenepropylene (FEP), and polyphenylenesulfide (PPS), polyetersulfone (PES) etc. The polymer systems may further comprise additives such as, but not limited to, plasticizers, anti-degradation agents as antioxidants, diluents, toughening agents, synthetic rubber and combinations thereof.

The polymer system design makes it possible to reach the desired properties of the impregnated compacted body such as improved mechanical strength, temperature resistance, acoustic properties and/or machinability.

The present invention permits design and engineering of a variety of polymer phases for a variety of applications by incorporation of nanometer-sized and/or micrometer-sized reinforcement structures such as for example particles, platelets, whiskers, fibres, and/or tubes as functional fillers in the polymer systems. The term "nanometer-size" is here meant as sizes wherein at least two dimensions of a three-dimensional structure is in the range of 1 nm to 200 nm. Also, micrometer-sized materials such as fibres, whiskers, and particles in the range of 200 nm to 5 μm may, for example, be used when the interpenetrating network voids in e.g. a compacted body are large.

These structures may contribute with improved properties to the interpenetrating networks of the polymer systems/impregnants. To accomplish a desired dispergation in the polymer phase, the nanometer-size structures may be chemical functunalized. The functionalized nanometer-size and/or micrometer-sized structures may further be dispersed in the polymer phase by adding with compatible solvents, treating with heat, treating with vacuum, stirring, caldendering, or ultrasonic treatment, forming a here denoted liquid polymer composite.

Carbon nanotubes (CNT), i.e. single- or multi-walled nanotubes (SWNT, MWNT) and/or other nanometer-sized materials may, for example, be used as reinforcement structures in the polymer systems.

At least two dimensions of each individual constituent of a functional filler and/or reinforcement structure may, for example, be less than 200 nm, alternatively for example less 50 nm, and alternatively less than 10 nm.

The shape of the functional filler and/or reinforcement constituents may, for example, be elongated, such as tubes and/or fibres and/or whiskers for example showing lengths between 0.2 μm to 1 mm.

The surface of the functional filler and/or reinforcement constituents may, for example, be chemically functionalized in order to be compatible with a chosen polymer system.

Thereby, the functional filler and/or reinforcement constituents may become substantially completely dispersed in the polymer system and to avoid aggregation. Such functionalization may, for example, be conducted using surface modifiers, cross-linkers, coupling- and/or wettability agents, which can be various types of organic functional silanes or silazanes, titanates, aluminates, or zirconates. Other metal alkoxides as well as inorganic silanes, silazanes, siloxanes, and silicic acid esters may also be used.

Nanometer-sized structures, such as carbon nanotubes and nanoparticles, are available from many and increasing amount of suppliers. Polymer resins reinforced with CNT's are commercially available from for example Amroy Europe, Inc (Hybtonite®) or Arkema/Zyvex Ltd (NanoSolve®).

In general, any of the technical features and/or embodiments described above and/or below may be combined into one embodiment. Alternatively or additionally any of the technical features and/or embodiments described above and/or below may be in separate embodiments. Alternatively or additionally any of the technical features and/or embodiments described above and/or below may be combined with any number of other technical features and/or embodiments described above and/or below to yield any number of embodiments.

Although some embodiments have been described and shown in detail, the invention is not restricted to them, but may also be embodied in other ways within the scope of the subject matter defined in the following claims. In particular, it is to be understood that other embodiments may be utilised and structural and functional modifications may be made without departing from the scope of the present invention.

In device claims enumerating several means, several of these means can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

As can be seen from the following examples, a novel type of soft magnetic composite components can be obtained by the method according to the invention.

EXAMPLES

The invention is further illustrated by the following non-limiting examples;

Example 1

As starting material Somaloy® 700 available from Höganäs AB was used. One composition, (sample A), was mixed with 0.3 weight % of an organic lubricant, stearamide, and a second composition, (sample B), with 0.6 wt % of an organic lubricant binder, the polyamide Orgasol® 3501.

The compositions were compacted at 800 MPa into toroid samples having an inner diameter of 45 mm, outer diameter of 55 mm and height of 5 mm, and into Transverse Rupture Strength samples (TRS-samples) to the densities specified in table 1. The die temperature was controlled to a temperature of 80° C.

After compaction the samples were ejected from the die and subjected to heat treatment. Three compacts of sample A were treated at 530° C. for 15 minutes in an atmosphere of air (A1) and nitrogen (A2, A3), respectively. Sample A2 was further subjected to impregnation according to the invention using an epoxy resin reinforced with CNT's. The third compact of sample A, treated in nitrogen, was further subjected to steam treatment at 520° C. according to the process described in WO2006/135324 (A3). A compact of sample B was treated at 225° C. for 60 minutes in air.

Transverse Rupture Strength was measured on the TRS-samples according to ISO 3995. The magnetic properties were measured on toroid samples with 100 drive and 100 sense turns using a hysterisisgraph from Brockhaus. The coercivity is measured at 10 kA/m, and the core loss is measured at 1 T and 400 Hz.

TABLE 1

| Sample | Additive | Heat Treatment | Atmosphere | Density [g/cm3] | TRS [MPa] | TS [MPa] | Coercive Force, $H_c$ [A/m] |
|---|---|---|---|---|---|---|---|
| A1 (ref) | 0.30 wt % | 530° C., | N2 | 7.54 | 43 | 8 | 200 |
| A2 | Stearamide | 15 min | N2 + Impreg. | 7.54 | 120 | 62 | 180 |
| A3 | | | N2 + Steam | 7.54 | 130 | 66 | 220 |
| B | 0.60 wt % Polyamide | 225° C., 60 min | AIR | 7.40 | 105 | 40 | 300 |

As can be seen from table 1, high mechanical strength of the samples can be reached by a process according to the invention (A2), by internal oxidation (A3), or by adding an organic binder to the powder composition (B). However, the use of the organic binder restricts the heat treatment temperature to 225° C., giving poor magnetic properties. The steam treated sample (A3), shows high strength, but high coercivity ($H_c$) compared to the impregnated sample (A2). The sample produced according to the invention (A2) exhibit high mechanical strength in combination with low coercive force.

Example 2

An electrically insulated soft magnetic powder, Somaloy® 700, available from Höganäs AB, was mixed with 0.5 wt % of stearamide (C), Ethylene bisstearamide wax (EBS wax) (D), and Zn-stearate (E), respectively, and compacted to 7.35 g/cm$^3$. The samples were further subjected to a heat treatment for 45 minutes in air at 350° C., or in an atmosphere of nitrogen at 530° C. One sample with stearamide (C2) was delubricated in air at 530° C. All delubricated components were thereafter subjected to impregnation according to the invention using an epoxy resin reinforced with CNT's. The magnetic and mechanical properties were measured according to example 1 and summarised in table 2 below.

TABLE 2

| Sample | Vaporization Treatment | TRS [MPa] | Resistivity [μOhm * m] | Core loss [W/kg] | Overall performance |
|---|---|---|---|---|---|
| C (Stearamide) | 1. 350° C. Air | 100 | 500 | 70 | Poor |
| | 2. 530° C. Air | 50 | 200 | 50 | Poor |
| | 3. 530° C. $N_2$ | 120 | 150 | 55 | Good |
| D (EBS Wax*) | 1. 350° C. $N_2$ | 40 | 450 | 73 | Poor |
| | 2. 530° C. $N_2$ | 120 | 120 | 58 | Acceptable |
| E (Zn-Stearate) | 1. 350° C. $N_2$ | 40 | 400 | 76 | Poor |
| | 2. 530° C. $N_2$ | 90 | 100 | 73 | Acceptable |

*Ethylene bis-stearamide (Acrawax ®)

As can be seen from table 3, the atmosphere and the temperature, at which the vaporization is conducted is of great importance.

Stearamide (sample C) is completely vaporized above 300° C. in both inert gas atmosphere and in air. If the vaporization is performed in air at a too high temperature, the surface pores are blocked and prevents a subsequent impregnation to succeed giving low TRS (C2). If the heat treatment is conducted in an oxidative atmosphere at a lower temperature, the impregnation can be successful, but gives unacceptable magnetic properties (C1).

The EBS wax (sample D) cannot be vaporized at 350° C., but is removed from the compact at above 400° C. If the vaporization temperature is too low, the residual organic lubricant will block the pores. Zn-stearate is vaporized at above 480° C., but leaves ZnO which leads to poorly impregnated compacts having low strength. The highest possible vaporization temperature is preferred as this gives desired strain relaxation and thus lowers coercivity and core loss.

Example 3

In this example, Somaloy® 500 powder, available from Höganäs AB, having a mean particle size smaller than the mean particle size of Somaloy® 700 was used. Somaloy® 500 was mixed with 0.5 wt % of stearamide and compacted at 800 MPa using a tool die temperature of 80° C. Two compact samples was further subjected to a heat treatment in inert gas for 15 minutes at 500° C. (sample F and G). Sample G was further subjected to impregnation according to the invention using an anaerobic acrylic resin reinforced with CNT's.

The magnetic and mechanical properties were measured according to example 1.

TABLE 3

| Sample | Density [g/cm 3] | TRS [MPa] | Resistivity [μOhm*m] | Core loss [W/kg] |
|---|---|---|---|---|
| F (Stearamide) | 7.36 | 45 | 200 | 65 |
| G (Stearamide) | 7.36 | 130 | 200 | 65 |

Table 3 clearly shows that the invention can be used for manufacturing components based on electrically insulated powders having finer particle size.

Example 4

As starting material Somaloy® 700, available from Höganäs AB, was used. All powder samples were mixed with 0.3 weight % of an organic lubricant, stearamide. The compositions were compacted at 1100 MPa into TRS-bars (30×12×6 mm) of density 7.58 g/cm3. The die temperature was controlled to a temperature of 80° C. The mechanical properties were measured according to example 1 and summarised in table 4 below.

After compaction the samples were subjected to a heat treatment in inert atmosphere for 15 minutes at 550° C. The porous network of the compacts were thereafter impregnated according to the invention using various types of impregnants, i.e. reinforced curable polymers systems. All liquid polymer composites show low viscosity at ambient temperature. As reinforcement was SWNT used with 1.0% per weight of polymer.

TABLE 4

| Sample | Polymer resin | Hardener | Reinforcment | TRS @RT [MPa] | TRS @150° C. [MPa] |
|---|---|---|---|---|---|
| H (Ref) | None | None | None | 40 | 40 |
| I | Epoxi type polymer (Amroy G4) | Amroy CA 25 | None | 70 | 50 |
| | | | CNT | 130 | 110 |
| J | Epoxi type polymer (TGDDM) | Isoforon-diamine | None | 65 | 60 |
| | | | CNT | 120 | 110 |
| K | Acrylic-type polymer (Omnifit 230M) | Anaerobic | None | 60 | 45 |
| | | | CNT | 120 | 105 |
| L | Thermoplatic polymer (PP) | None | None | 70 | 65 |
| | | | CNT | 120 | 110 |

As can been seen from table 4, the TRS is improved significantly for all types, but when reinforced the improvement of mechanical strength (e.g. 20 TRS) is superior. By carefully choosing the polymer system (i.e. impregnant) the mechanical strength can be retained at temperatures of 150° C. or higher.

Example 5

As starting material Somaloy® 700, available from Höganas AB, was used. All powder samples were mixed with 0.3 weight % of an organic lubricant, stearyl erucamide (SE). The compositions were compacted at 800 MPa or 1 100 MPa using a die temperature of 60° C., to a density of 7.54 g/cm$^3$, except for sample M3, which were compacted to 7.63 g/cm$^3$ using 0.2 wt % SE.

After compaction the samples were subjected to a heat treatment in inert atmosphere at 550° C. for 15 minutes. The porous network of the compacts were thereafter filled using various types of impregnants, such as curable polymers systems or non-curable oils, either reinforced or not. All impregnants show low viscosity at ambient temperature and are listed in table 6.

The magnetic properties were measured on OD64×H20 mm cylinders after machining by turning into OD64/ID35×H14.5 mm toroids (100 drive and 50 sense).

TABLE 5

| Impregnant | Reinforcement | TRS @ RT [MPa] | Coercivity [A/m] | Max. permeability | Machin-ability |
|---|---|---|---|---|---|
| M. Epoxy resin | 1. None | 70 | 180 | 500 | Acceptable |
| | 2. CNT | 120 | 175 | 550 | Excellent |
| | 3. CNT* | 100 | 170 | 570 | Good |
| N. Acrylic resin | 1. None | 80 | 182 | 350 | Acceptable |
| (Loctite ® 290) | 2. CNT | 130 | 178 | 450 | Good |
| O. Thermoplastic | 1. None | 60 | 184 | 450 | Acceptable |
| (LDPE) | 2. CNT | 120 | 180 | 550 | Excellent |
| P. Oil (Nimbus ® 410) | None | 45 | 185 | 280 | Poor |
| Q. Loctite ® Resinol RTC | None | 65 | 180 | 360 | Acceptable |
| R. Reference 1 Steam treated** | — | 120 | 225 | 250 | Very poor |
| S. Reference 2 Conventional*** | — | 55 | 210 | 230 | Poor |

*Pressed density 7.63 g/cm3

**Machined after steam treatment

***Green machined and subsequently heat treated in air at 530° C.

Low permeability can indicate presence of cracks and lamination, which derives from abrasive forces and vibrations during the machining work. Also, the coercive force may be increased if the machining properties are reduced. Signs of poor machining properties are smeared surface finish, break-outs, cracks, and tool wear. Sample P to S are incorporated for comparison.

Parts which have been green machined (S) and oxidized for improved strength (R), show not only high coercivity, but also poor machining properties and, thus, poor magnetic properties. Excellent magnetic properties 15 after machining can be obtained when the impregnator show good machining properties together with high mechanical strength, especially samples M-2, N-2, and O-2.

The invention claimed is:

1. A method for producing a composite part, the method comprising:

compacting a soft magnetic powder composition comprising a lubricant into a compacted body;

heating the compacted body to a temperature above the vaporisation temperature of the lubricant such that the lubricant substantially is removed from the compacted body;

impregnating the obtained heat treated compacted body with a liquid polymer composite comprising carbon nanotubes, wherein prior to impregnation the obtained heat treated compacted body has a density above about 7.0 g/cm$^3$; and solidifying the heat treated compacted body comprising liquid polymer composite by drying and/or by at least one curing treatment.

2. The method according to claim 1, wherein the powder composition further comprises an iron-based powder.

3. The method according to claim 1, wherein particles in the powder composition comprise an electrically insulating, inorganic coating.

4. The method according to claim 3, wherein said lubricant has a temperature of vaporization below a decomposition temperature of said electrically, insulating, inorganic coating.

5. The method according to claim 1, wherein the step of heating the compacted body to a temperature above the vaporisation temperature of the lubricant is performed in a non-oxidizing atmosphere.

6. The method according to claim 1, wherein the method further comprises the step of reducing the pressure of the heat treated compacted body subjected to a liquid polymer composite for a period of time.

7. The method according to claim 1, wherein the method further comprises the step of elevating the temperature of the heat treated compacted body subjected to a liquid polymer composite.

8. The method according to claim 6, wherein the method further comprises the step of increasing the pressure to atmospheric pressure or higher after the pressure has been reduced.

9. The method according to claim 1, wherein the method further comprises the step of rinsing and/or cleaning the heat treated compacted body from excessive liquid polymer composite.

10. The method according to claim 1, wherein at least two dimensions of the reinforcement structures are below 5 μm.

11. The method according to claim 1, wherein the carbon nanotubes comprise single wall nanotubes.

12. The method according to claim 1, wherein the liquid polymer composite comprises a curable organic resins chosen from the group of:

thermoset resin, thermo-plastic, and anaerobic acrylics.

13. The method according to claim 1, wherein the lubricant is chosen from the group of:

primary amides;

secondary amides of saturated or unsaturated fatty acids;

saturated or unsaturated fatty alcohols;

amide waxes, and combinations thereof.

14. A method according to claim 1, wherein the step of compacting said powder composition is performed at an elevated temperature.

15. The method according to claim 1, wherein the step of heating the compacted body further comprises a sintering step of the compacted body.

16. The method of claim 1, wherein the obtained heat treated compacted body that is subjected to the liquid polymer composite comprising carbon nanotubes, has a density above about 7.5 g/cm$^3$.

17. The method of claim 1, wherein the obtained heat treated compacted body that is subjected to the liquid polymer composite comprising carbon nanotubes, has a density above about 7.7 g/cm$^3$.

* * * * *